US006533063B1

(12) United States Patent
Ikeuchi et al.

(10) Patent No.: US 6,533,063 B1
(45) Date of Patent: Mar. 18, 2003

(54) VIDEO EQUIPMENT SPEAKER DEVICE WITH ACOUSTIC LENS

(75) Inventors: Kazuhiko Ikeuchi, Takatsuki (JP); Tomio Shiota, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 3 days.

(21) Appl. No.: 09/610,359

(22) Filed: Jul. 5, 2000

(30) Foreign Application Priority Data

Jul. 6, 1999 (JP) ..... 11-192146

(51) Int. Cl.[7] ..... G10K 11/00
(52) U.S. Cl. ..... 181/176; 181/175
(58) Field of Search ..... 181/141, 150, 181/155, 175, 176; 381/386, 388, 352, 160, 337, 350, 336, 300, 306, 345, 87, 333, 335

(56) References Cited

U.S. PATENT DOCUMENTS 4,164,631 A 8/1979 Garner et al.
5,274,709 A 12/1993 Koizumi
5,946,403 A * 8/1999 Josephson et al. ..... 381/122
6,031,920 A * 2/2000 Wiener ..... 381/160
6,134,332 A * 10/2000 Wiener ..... 181/155

FOREIGN PATENT DOCUMENTS

| | | |
|---|---|---|
| GB | 968480 | 9/1964 |
| JP | 5-236583 | 9/1993 |
| JP | 5-236585 | 9/1993 |
| JP | 6-35489 | 2/1994 |

* cited by examiner

*Primary Examiner*—Kim Lockett
(74) *Attorney, Agent, or Firm*—Wenderoth, Lind & Ponack, L.L.P.

(57) ABSTRACT

In video equipment, a video equipment speaker device that is almost invisible from a viewer and capable of placing, toward the front of the center portion of the screen, an acoustic image from a speaker 2 provided on at least either an upper or lower portion of a screen is provided. A speaker device 1 includes the speaker 2, a sound duct 3 positioned forward of the speaker 2 to externally output sound, a speaker baffle 4 provided in the vicinity of edges forming an opening of the sound duct 3 and formed to outwardly reflect the sound, a fin 5 provided forward of the speaker baffle 4, sound space 6 formed between the speaker baffle 4 and the fin 5, and slits 7 outwardly opened from the sound space 6.

18 Claims, 10 Drawing Sheets

VIDEO EQUIPMENT SPEAKER DEVICE WITH ACOUSTIC LENS

BACKGROUND OF THE INVENTION

1. Field of the Invention

The present invention relates to speaker devices to be used with video equipment such as a display monitor, television, and personal computer and, more specifically, to a video equipment speaker device with an acoustic lens.

2. Description of the Background Art

Speaker devices are often equipped with an acoustic lens. The acoustic lens is used for setting a directivity of a speaker device to a desired direction. Conventionally, the acoustic lens for the speaker device is implemented by a plurality of fins. Such speaker device is exemplarily disclosed in Japanese Patent Laid-open No. 6-35489 (1994-35489).

FIG. 14 is a perspective view of a television equipped with television speaker devices having acoustic lenses. In FIG. 14, the television includes a television box 11, a Braun tube 10 provided on the center front of the television box 11, right-channel and left-channel speaker parts 12 provided on the upper-right, upper-left, lower-right, and lower-left portions on the front of the television box 11, center channel speaker parts 13 provided in the vicinity of the upper-center and lower-center on the front of the television box 11, and a plurality of acoustic lens fins 5 provided on the front of the television box 11 and forward of the speaker parts.

However, the structure of such a conventional acoustic-lens-equipped television speaker device poses some problems as follows. First, the complicated fin structure worsens the appearance of the speaker device. Second, each speaker part provided rearward of the fins is almost completely visible to a television viewer, and therefore, the entire appearance of the speaker device may be worsened. Lastly, a sound directivity is ensured only in the direction to which the fins are oriented, and thus is less spread out. If the speaker parts are arranged only on the upper or lower portion on the front of the television box, the reproduced acoustic image will be directed only to the upper or lower side of the television box.

Therefore, an object of the present invention is to provide a video equipment speaker device capable of, even if arranged only on the upper-front or lower-front of the video equipment, directing the acoustic image to the center on the front of the screen, and lending itself to being invisible to a viewer.

SUMMARY OF THE INVENTION

A first aspect of the present invention is directed to a video equipment speaker device having an acoustic lens, comprising: a speaker for forwardly outputting sound; a speaker baffle provided forward of the speaker with an opening through which the outputted sound passes; and a fin, as the acoustic lens, opposed to the speaker so as to form slots for sound passage with the speaker baffle. The fin has a shape in cross section such that a central portion of a surface opposed to the speaker is rearwardly curved, wherein the sound outputted from the speaker passes through the opening and reflects between the fin and the speaker baffle to be externally outputted from the slots.

As described above, in the first aspect, the acoustic lens itself is invisible from a viewer of the video equipment. Therefore, the speaker device can be provided without its appearance worsened. Further, with the narrow slots, a sound source becomes analogous to a simple sound source, and therefore, the directivity can be broadened.

According to a second aspect, in the first aspect, the fin has a shape so that the opening of the speaker baffle is not entirely covered when viewed from the front of the video equipment.

As described above, in the second aspect, sufficient sound volume can be maintained while sound pressure is not reduced by the fin. Further, with the narrow slots, the sound source becomes analogous to a simple sound source, and therefore, the directivity can be broadened.

According to a third aspect, in the second aspect, the fin is provided at a position that avoids intersecting with a central axis for sound outputted from the speaker.

As described above, in the third aspect, part of the sound outputted from the central portion of the speaker is not interfered with by the fin. Therefore, since the sound of high-range frequencies is directly outputted from the opening, the sound of the entire range can be outputted with high-frequency characteristics of the speaker unchanged.

According to a fourth aspect, in the third aspect, the central axis passes through one of the slots formed between the fin and the speaker baffle, and part of the sound outputted from the speaker is directly outputted from the slot.

As described above, in the fourth aspect, the sound of high-range frequencies outputted from the central portion of the speaker is directly outputted from the slot. Therefore, the sound of high-range frequencies, which is high in directivity, can be outputted without being obstructed by the fin, allowing high-frequency characteristics of the speaker to be unchanged.

According to a fifth aspect, in the first aspect, the fin is of a rectangular shape when viewed from the front of the video equipment.

As described above, in the fifth aspect, the fin is of a rectangular shape. The fin can thus be positioned along each side of the front of the video equipment. Therefore, the directivity can be broadened without the appearance of the speaker device being worsened.

According to a sixth aspect, in the first aspect, the fin has one or more apertures, and part of the sound outputted from the speaker is externally outputted through the apertures.

As described above, in the sixth aspect, the fin has one or more apertures. Therefore, the sound of high and mid-range frequencies, especially high-range frequencies, can be sufficiently reproduced.

According to a seventh aspect, in the first aspect, a total area of the slots between the fin and the speaker baffle that correspond to the opening of the speaker baffle is approximately equal to an area of the opening rearward of the speaker baffle.

As described above, in the seventh aspect, the total area of the slots between the fin and the speaker baffle that correspond to the opening of the speaker baffle is approximately equal to the area of the opening rearward of the speaker baffle, thereby extremely reducing acoustic resistance. Therefore, the acoustic characteristics and phase can be stabilized, and especially, the acoustic characteristics in high-range and mid-range frequencies can be improved.

According to an eighth aspect, in the first aspect, the central portion of the rearwardly-curved surface of the fin is positioned closer to the speaker through the opening of the speaker baffle.

As described above, in the eighth aspect, acoustic resistance toward the opening is equalized. Therefore, the acoustic characteristics and phase can be stabilized. Also, as the opening is narrower, the sound source becomes analogous to a simple sound source, thereby broadening the directivity.

According to a ninth aspect, in the first aspect, the speaker device is provided on an upper-front and/or lower-front of the video equipment.

As described above, in the ninth aspect, broad directivity can be obtained in both horizontal and vertical directions even when speakers are provided on either an upper-front or lower-front, or both, of the video equipment.

According to a tenth aspect, in the first aspect, the speaker devices are provided on a front-right and front-left of the video equipment.

As described above, in the tenth aspect, broad directivity can be achieved in the horizontal direction if the speakers are provided on the front-right and front-left of the video equipment.

According to an eleventh aspect, in the first aspect, the speaker devices are provided on an upper-front and/or lower-front and a front-right and front-left of the video equipment.

As described above, in the eleventh aspect, the acoustic image can be easily directed to the central portion frontward of the screen even if the speakers are provided on either the upper-front or lower-front of the video equipment. Furthermore, with the speakers provided on the front-right and front-left of the video equipment, broadened directivity in the horizontal direction can be obtained. Therefore, a listener can feel the sound spreading more.

According to a twelfth aspect, in the eleventh aspect, the speaker devices provided on the front-right and front-left of the video equipment are specifically used for high-range frequencies.

As described above, in the twelfth aspect, the acoustic image can be easily directed, at low costs, to the center-front portion forward of the screen even if the speakers are provided on either the upper-front or lower-front of the video equipment. Furthermore, with the speakers provided on the front-right and front-left of the video equipment, broadened directivity in high-range frequencies in the horizontal direction can be obtained. Therefore, a listener can feel the sound spreading more.

A thirteenth aspect is directed to a video unit comprising a video unit box that accommodates a video unit circuit set, first speaker devices provided on an upper-front and/or lower-front of the video unit box, and second speaker devices provided on a front-right and front-left of the video unit box and specifically used for high-range frequencies. Each of the first speaker devices comprises: a speaker for forwardly outputting sound; a speaker baffle provided forwardly of the speaker with an opening through which the outputted sound passes; and a fin opposed to the speaker so as to form slots, for sound passage, with the speaker baffle. The fin has a shape in cross section such that a central portion of a surface opposed to the speaker is rearwardly curved, wherein the sound outputted from the speaker passes through the opening and reflects between the fin and the speaker baffle to be externally outputted from the slots.

As described above, in the thirteenth aspect, the right and left sides on the front surface of the video unit box can be visually simplified, compared to the case in which speaker devices with a fin are provided on a front-right and front-left thereof. Further, the acoustic image can be easily directed, at low costs, to the center-front portion forward of the screen even if the speakers are provided on either the upper-front or lower-front of the video equipment. Furthermore, with the speakers provided on the front-right and front-left of the video equipment, broadened directivity in high-range frequencies in the horizontal direction can be obtained. Therefore, a listener can feel the sound spreading more.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
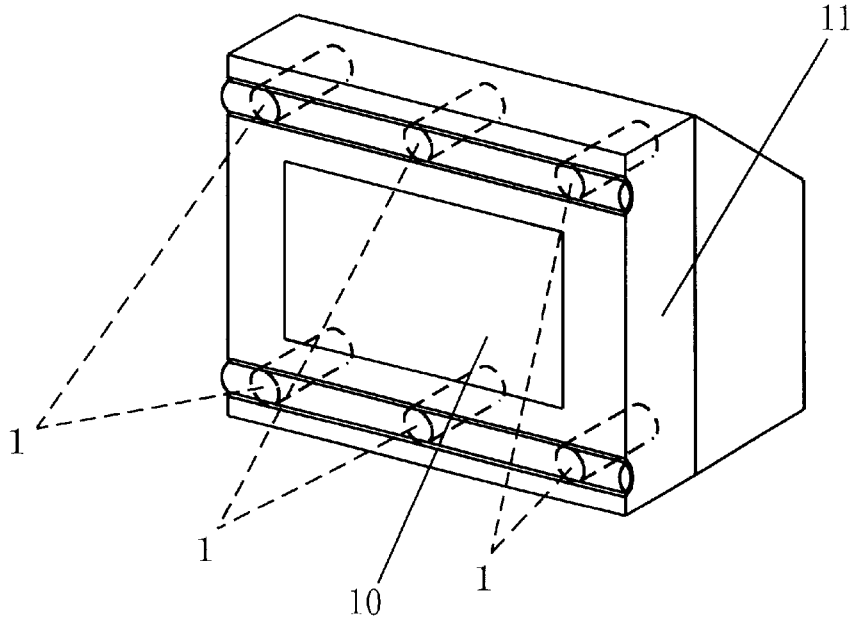
FIG. 1 is a perspective view showing the structure of a television including speaker devices according to a first embodiment of the present invention.

FIG. 1 is an external perspective view of a television including speaker devices according to a first embodiment of the present invention. In FIG. 1, the television is constructed of a television box 11, a Braun tube 10 provided in the vicinity of the center-front of the television box 11, and speaker devices 1 provided on the upper-right, upper-center, upper-left, lower-right, lower-center, and lower-left portions on the front of the television box 11.

Note that, in the present invention, these speaker devices 1 are not necessarily provided on both the upper-front and lower-front of the television box 11, but may be only on either one thereof. Furthermore, these speaker devices may be provided on the front-right and front-left thereof. Therefore, the positions of the speaker devices are not specifically limited to the above. Moreover, although the speaker devices applied to a television will be described below in the present embodiment, they may be applied to other video equipment such as a display monitor and personal computer.

Figure 2:
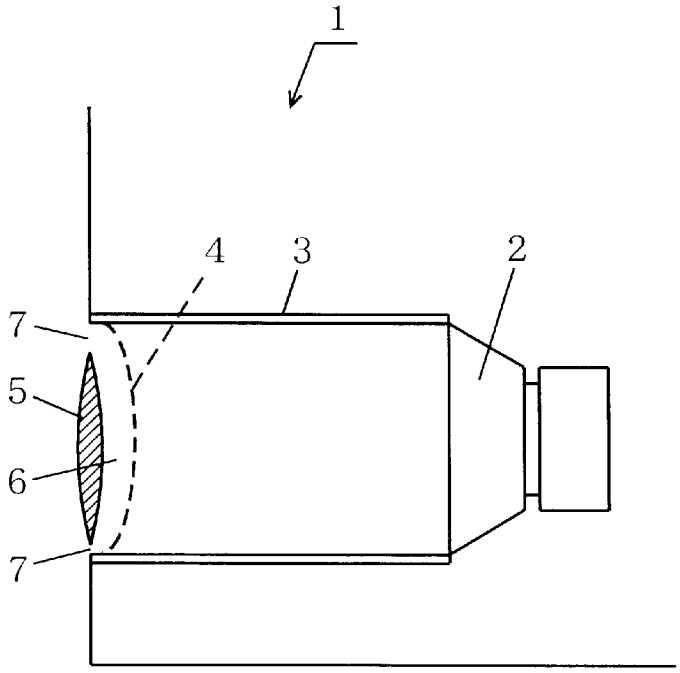
FIG. 2 is a cross-sectional view, taken from a side surface direction of the television, of the speaker device according to the first embodiment of the present invention to show the structure of slots and a sound output axis.

FIG. 2 is a cross-sectional schematic view, taken from a side surface of the television, of the speaker device according to the first embodiment of the present invention.

In FIG. 2, the speaker device 1 according to the first embodiment of the present invention includes a speaker 2, a sound duct 3 provided forward of the speaker 2 to externally output sound, a speaker baffle 4 provided in the vicinity of the external edge of the sound duct 3 to externally reflect the sound, a fin 5 provided forward of the speaker baffle 4, sound space 6 formed between the speaker baffle 4 and the fin 5, and slots 7 outwardly opening from the sound space 6. As can be seen, the slots 7 are defined between an inner periphery of the speaker baffle 4 and an outer periphery of the fin 5.

Note that the sound duct 3 is not necessarily required in the present invention. Therefore, the sound duct 3 may be omitted, and the speaker 2 may be positioned just behind the speaker baffle 4.

Figure 3:
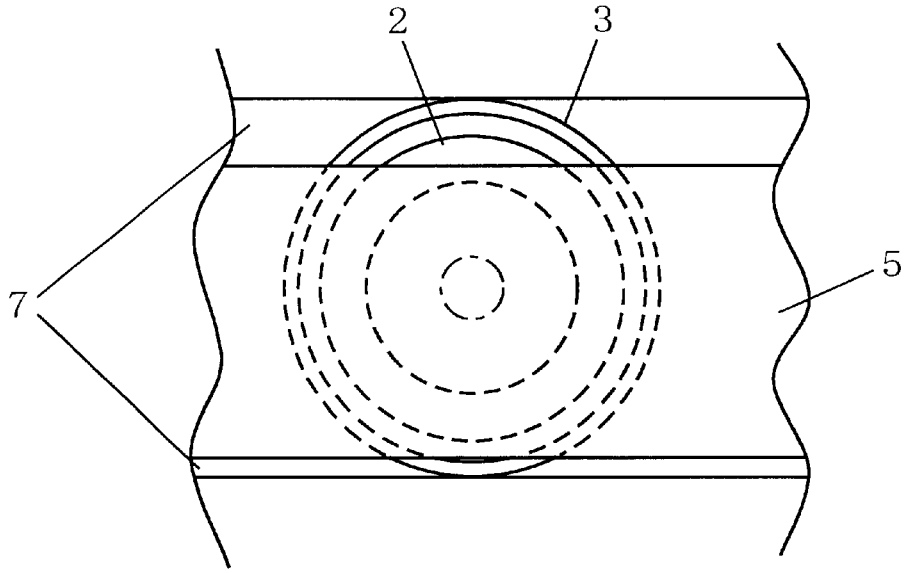
FIG. 3 is a partial front view of the speaker device according to the first embodiment of the present invention to show the structure of the slots and the sound output axis.

FIG. 3 is a partial front view of the speaker device according to the first embodiment of the present invention. The structure of the speaker device 1 is as such described above.

As shown in FIG. 2 or 3, the speaker device 1 according to the first embodiment of the present invention is characterized by the shapes of the speaker baffle 4 and the fin 5, and the sound space 6 and the slots 7 both formed by the speaker baffle 4 and the fin 5.

As shown in FIG. 2, the fin 5 is provided forward of the speaker baffle 4 and opposed in parallel to a plane through which sound is outputted from the speaker 2. The surface of the fin 5 opposed to the speaker 2 is curved rearwardly so that the center portion of the fin 5 is closer to the speaker 2 than are the upper and lower ends thereof.

The fin 5 typically has a cross-sectional profile such that its upper and lower portions are thinner and its center is thicker when viewed from the side surface direction. However, the front surface of the fin 5 may take any form as long as the rear surface thereof facing the speaker is shaped as described above.

Accordingly, the front surface of the fin 5 may also be curved rearwardly so as to correspond to the curve of the rear surface. For example, the fin 5 is formed from a bent plate of uniform thickness. Furthermore, irrespective of the shape of the rear surface of the fin 5, the shape of the front surface thereof may be flat and parallel to the surface on which the Braun tube 10 is provided.

Figure 5:
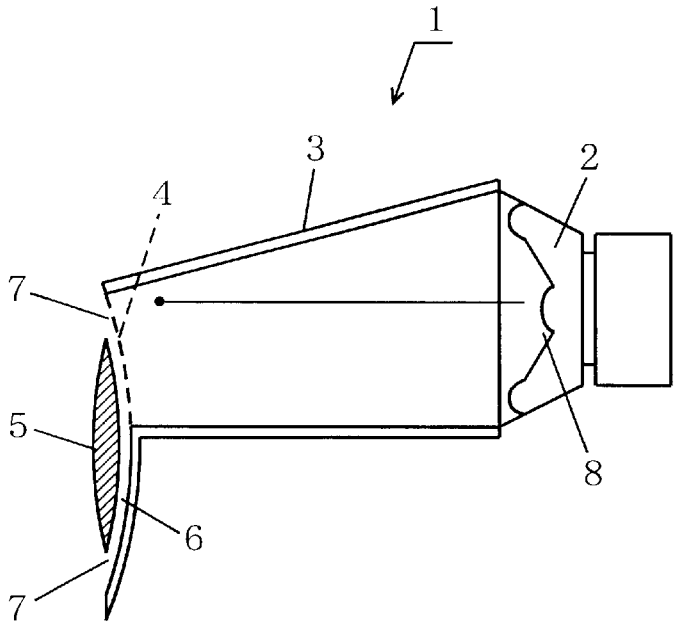
FIG. 5 is a cross-sectional view, taken from a side surface direction of the television, of a speaker device according to a second embodiment of the present invention to show the structure of slots with respect to a sound output axis.

Further, as shown in FIGS. 3 and 5, the fin 5 viewed from the front typically has a rectangular shape, but may be an oval, circular, or any other shape. Therefore, for example, the front surface of the fin 5 may be circular, while its rear surface is rearwardly curved.

The center portion of the fin 5 is positioned forward of the center of the speaker baffle 4. With the fin 5 positioned as such, the sound outputted from the speaker 2 is reflected by the curved surface of the fin 5. Part of the reflected sound is also reflected by the speaker baffle 4, and externally outputted from the slots 7.

Furthermore, in FIG. 2, the sound space 6 is formed between the fin 5 and the speaker baffle 4, and the slots 7 opening outwardly from the sound space 6 are provided. It is assumed herein that the height of the fin 5 is slightly smaller than the diameter of the sound duct 3.

Figure 4:
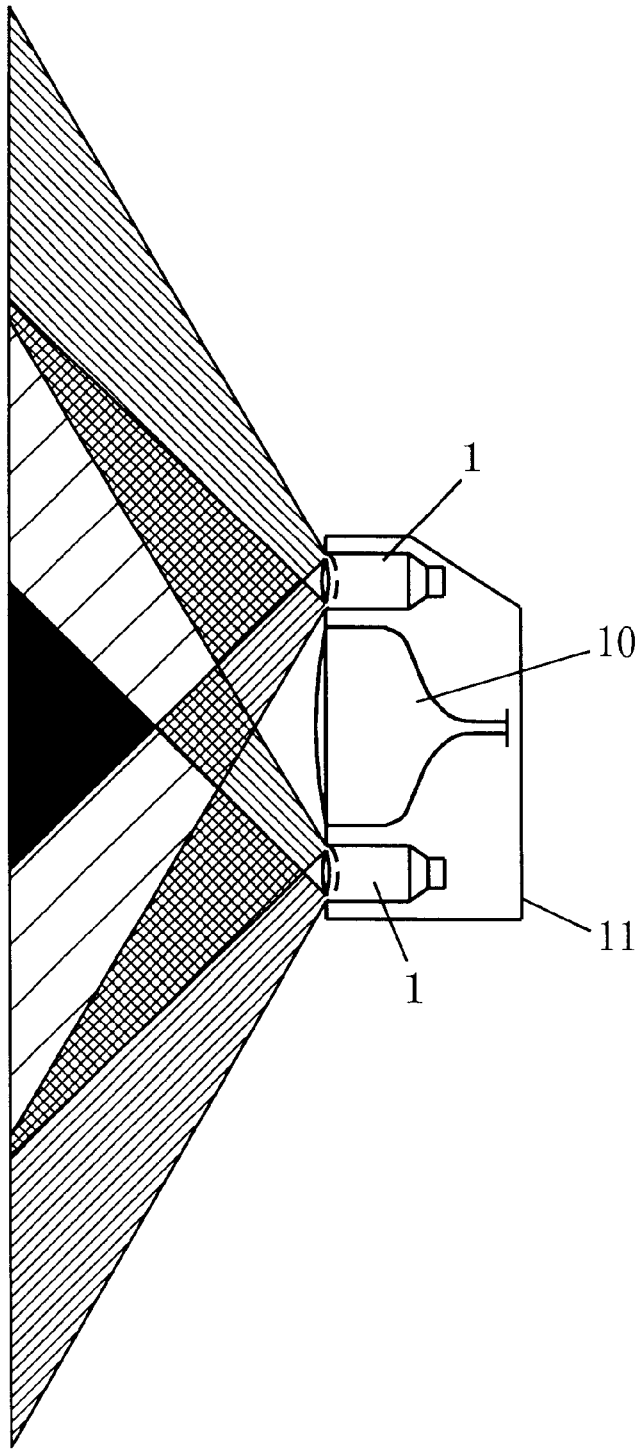
FIG. 4 is a schematic diagram representing vertical sound dispersion from the speaker devices according to the first embodiment of the present invention.

Under such assumption, as shown in FIG. 4, the slots 7 are narrowly formed, and the sound source becomes analogous to a simple sound source. FIG. 4 is a schematic diagram representing vertical sound dispersion from the speaker device according to the first embodiment of the present invention. Since simple sound sources can generate the broadest directivity, the above-structured speaker device according to the present embodiment can generate broad directivity.

Needless to say, even if the height of the fin 5 is equal to or slightly larger than the diameter of the sound duct 3, the slots 7 can be formed by spacing the fin 5 and the speaker baffle 4 a certain amount apart. Therefore, the height of the fin 5 is not limited to that described above in the present embodiment. However, if the height is smaller than the diameter of the sound duct 3, sound reflected by the fin 5 is reduced, and acoustic resistance and acoustic mass that affect high-range audio frequencies are accordingly reduced. Therefore, the present embodiment is preferable because the sound of high-range frequencies is sufficiently reproduced.

Furthermore, the fin 5 may have one or more apertures penetrating through its surfaces. The position and size of the apertures are not limited, but preferably determined so as not to worsen the appearance of the speaker device. With such apertures on the fin 5, reflection by the fin 5 is reduced, and thereby acoustic resistance and acoustic mass that affect especially high-range frequencies can be reduced. As a result, the sound of high-range frequencies is sufficiently reproduced.

However, the directivity becomes narrower as the total area of the apertures becomes too large. Therefore, the total area of the apertures is preferably determined so that the directivity can be broadened and the sound of high-range frequencies can be sufficiently reproduced.

Second Embodiment

Figure 6:
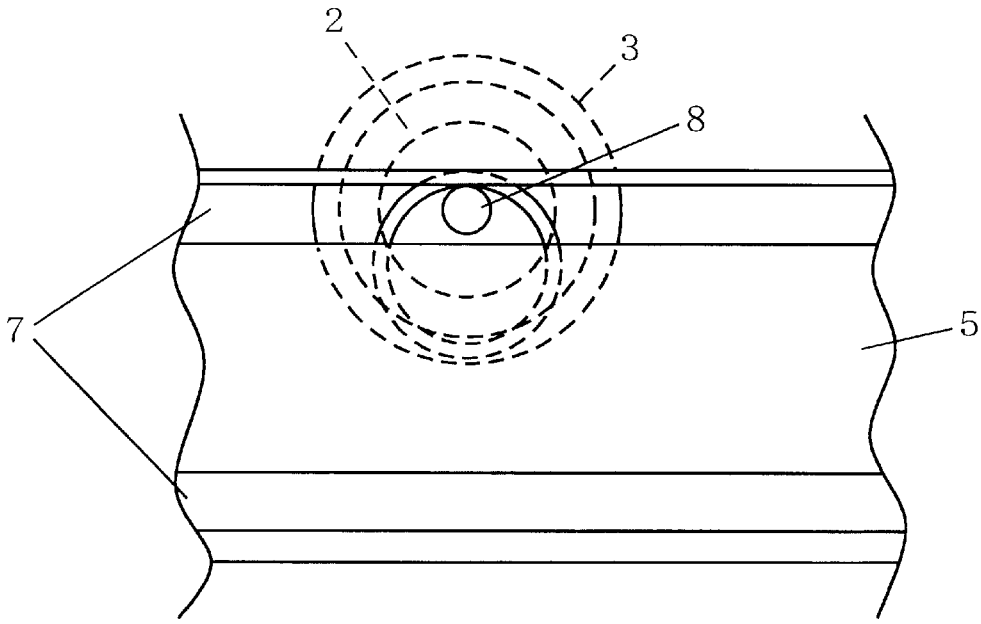
FIG. 6 is a partial front view of the speaker device according to the second embodiment of the present invention to show the structure of the slots and the sound output axis.

FIG. 5 is a schematic cross-sectional view of a speaker device according to a second embodiment of the present invention. FIG. 6 is a partial front view of the speaker device. Since having functions similar to those in FIG. 2, the components of the speaker device in the second embodiment are provided with the same reference numerals as those in FIG. 2, and only the difference from FIG. 2 will be described below.

In FIG. 5, the fin 5 is at a position that avoids intersecting with an output central axis for the sound outputted from the speaker 2. Since the output central axis passes through the slot 7, the sound along the output central axis is directly outputted to the exterior of the speaker device 1. As shown in FIG. 6, if viewing from the front of the above-structured speaker device 1, the viewer can see, through the slot 7, a dust cap 8 formed at the center of a diaphragm of the speaker 2.

As described above, the sound of high-range frequencies outputted from the center of the speaker 2 is directly outputted from the slot 7 to the exterior of the speaker device 1. Therefore, the sound can be outputted with high-frequency characteristics of the speaker unchanged.

Third Embodiment

Figure 7:
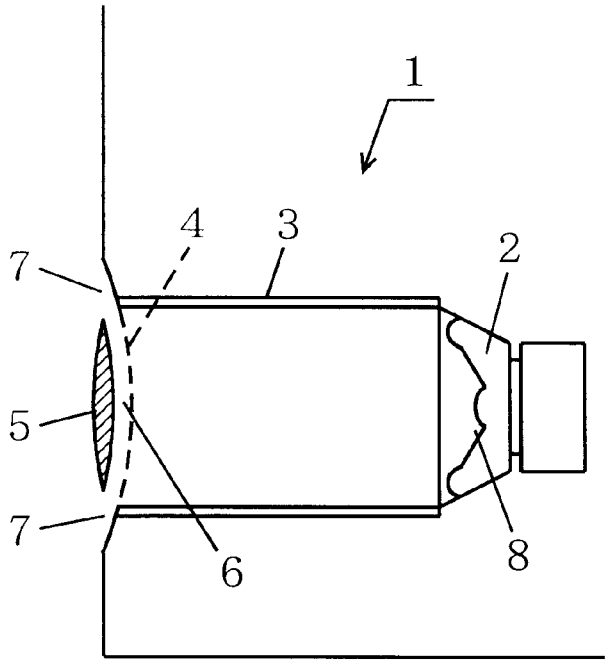
FIG. 7 is a schematic diagram showing the structural relationship between a fin and a baffle in a speaker device according to a third embodiment of the present invention.

FIG. 7 is a schematic diagram showing a speaker device according to a third embodiment of the present invention. Since having the functions similar to those in FIG. 2, the components shown in FIG. 7 are provided with the same reference numerals as those in FIG. 2, and only the difference from FIG. 2 will be described below.

In FIG. 7, the fin 5 and the speaker baffle 4 are approximately evenly spaced apart so that the area of an opening rearward of the speaker baffle 4; that is, the area of an opening of the sound duct 3, becomes approximately equal to the total area of the slots 7 that correspond to the opening of the sound duct 3.

Such structure approximately equalizes the values of acoustic resistance at the two slots 7 formed on the upper and lower sides of the fin 5, and thereby can stabilize the acoustic characteristics and phase. Furthermore, since the slots 7 are formed narrowly to make the sound source become analogous to a simple sound source, the directivity can be broadened.

As stated above, the above-described effects can be achieved when the fin 5 and the speaker baffle 4 are spaced apart so that that the area of the opening rearward of the speaker baffle 4; that is, the area of the opening of the sound duct 3, becomes approximately equal to the total area of the slots 7 that correspond to the opening of the sound duct 3. Graphs representing measurement results of the effects are shown in FIGS. 8A, 8B, 9A, and 9B. Considered below are the results shown in these drawings and the reasons therefor.

FIGS. 8A, 8B, 9A, and 9B are graphs showing how the acoustic characteristics of the speaker device are changed as the distance between the fin 5 and the speaker baffle 4 is changed. Note that the distance referred to herein is between the rear end of the fin 5 and the opening of the speaker baffle 4 on the sound output central axis. The diameter of a sound duct in a speaker device used for measurement is 44 mm; the length of the sound duct is 270 mm; and the voluminous capacity of the sound duct is 0.3 liters.

Figure 8A:
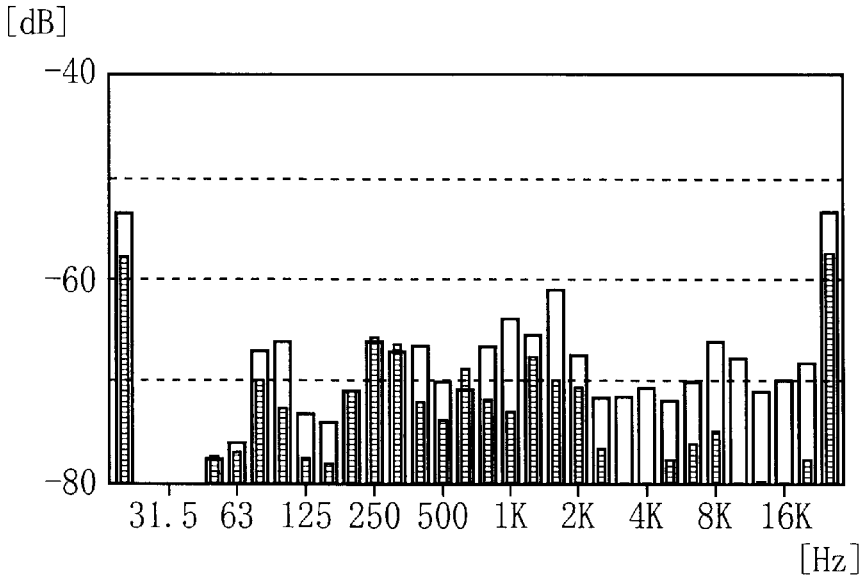
FIG. 8A is a graph showing acoustic characteristics when the fin and the speaker baffle are spaced 0 mm apart in the speaker device according to the third embodiment of the present invention.
Figure 8B:
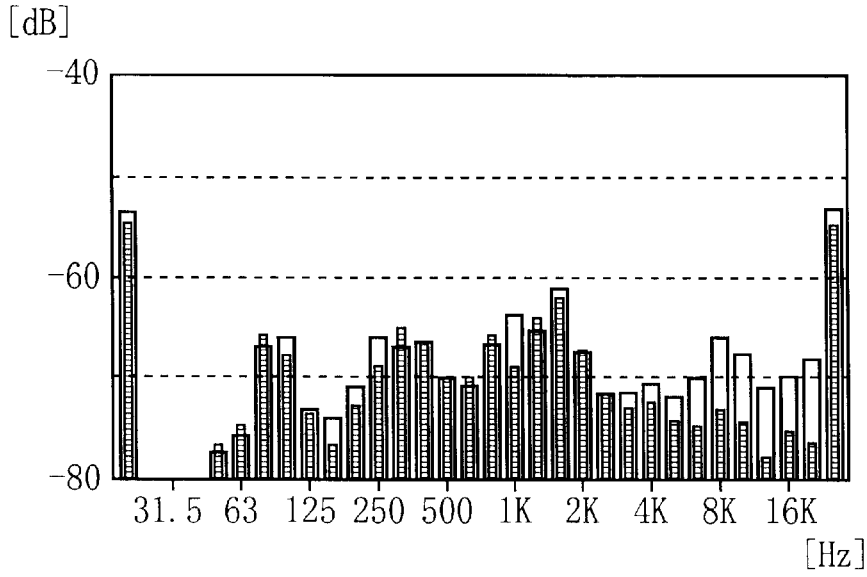
FIG. 8B is a graph showing acoustic characteristics when the fin and the speaker baffle are spaced 5 mm apart in the speaker device according to the third embodiment of the present invention.
Figure 9A:
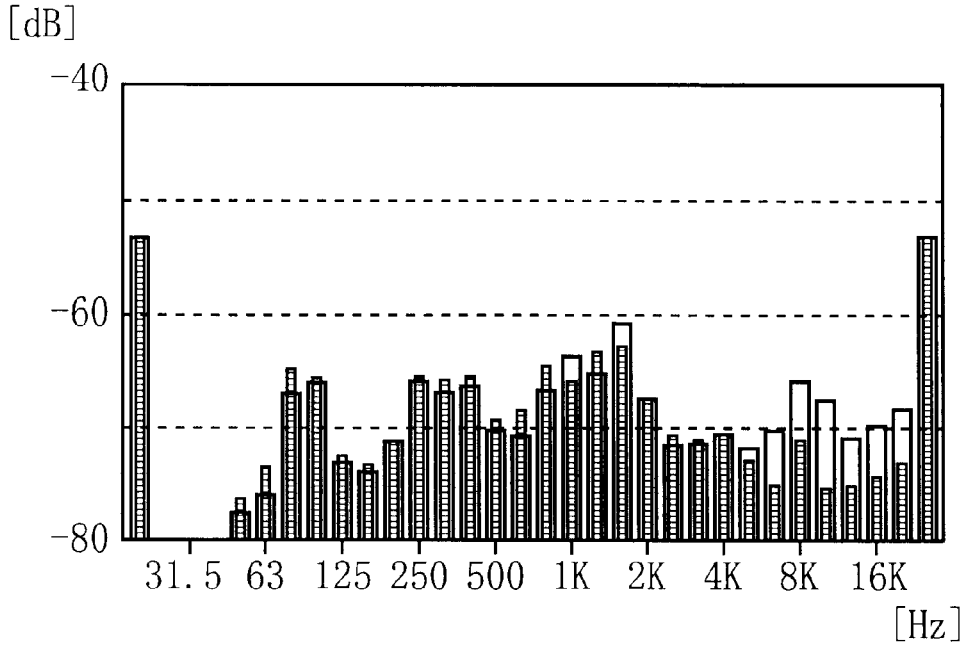
FIG. 9A is a graph showing acoustic characteristics when the fin and the speaker baffle are spaced 10 mm apart in the speaker device according to the third embodiment of the present invention.
Figure 9B:
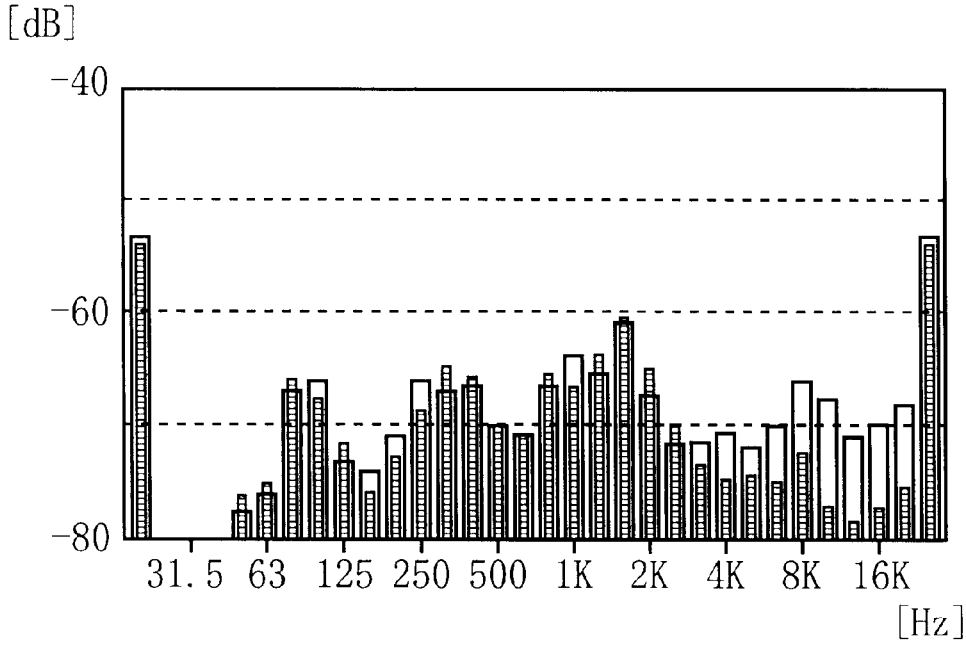
FIG. 9B is a graph showing acoustic characteristics when the fin and the speaker baffle are spaced 15 mm apart in the speaker device according to the third embodiment of the present invention.

The distance between the fin 5 and the speaker baffle 4 is 0 mm in FIG. 8A; 5 mm in FIG. 8B; 10 mm in FIG. 9A; and 15 mm in FIG. 9B. With such distance, the acoustic characteristics of the speaker device are measured, and represented by the graphs of these drawings with sound pressure (dB) as the vertical axis and frequency (Hz) as the horizontal axis.

In these graphs, the measurement values are represented by shaded bars. Slightly large blank bars superimposed thereon indicate values measured with the fin 5 removed. This allows easy comparison of degradation in acoustic characteristics.

As shown in FIG. 8A, if the fin 5 and the speaker baffle 4 are spaced 0 mm apart, significant degradation in acoustic characteristics is observed in high and mid-range frequencies, particularly in high-range frequencies. The reason for this degradation can be assumed as follows: If the opening of the sound duct 3 is closed by the fin 5, the sound duct 3 becomes a tube with both ends closed. As a result, the sound duct 3 becomes like a speaker enclosure with a given capacity. Therefore, the opening of the sound duct 3 serves as a low-pass filter that does not lend itself to passing high-range and mid-range frequencies, just like a bass-reflex port of a speaker enclosure.

As shown in FIG. 8B, if the distance is 5 mm, the acoustic characteristics in high-range and mid-range frequencies are slightly improved. The reason for this improvement can be assumed as follows: The fin 5 does not close the opening of the sound duct 3, but is isolated therefrom. Therefore, the acoustic resistance and acoustic mass can be reduced. Such reduction diminishes the effects of the low-pass filter.

As shown in FIG. 9A, if the distance is 10 mm, significant improvement in acoustic characteristics is observed. The reason for this improvement can be assumed as follows: The area of the opening rearward of the speaker baffle 4; that is, the area of the opening of the sound duct 3, becomes approximately equal to the total area of the slots 7 that correspond to the opening of the sound duct 3. As a result, the effects of air viscous drag and the acoustic mass are reduced to improve the acoustic characteristics in high-range and mid-range frequencies.

As shown in FIG. 9B; however, if the distance is 15 mm, the acoustic characteristics become slightly degraded. Although the characteristics become less degraded as the total area of slots 7 becomes larger, the directivity becomes narrow if the slots 7 become too large. That may be the reason for this slight degradation.

In other words, as described above, if the slots 7 are formed narrowly, the sound source becomes analogous to a simple sound source, thereby allowing broad directivity. If the slots 7 are formed broadly; however, the directivity becomes narrower. It can thus be thought that the acoustic characteristics outside the narrowed directivity become degraded.

Therefore, if the distance is 10 mm, the area of the opening rearward of the speaker baffle 4; that is, the area of the opening of the sound duct 3, becomes approximately equal to the total area of the slots 7 that correspond to the opening of the sound duct 3. Therefore, the acoustic characteristics can be maximized with broad directivity and reduced effects of air viscous drag.

Figure 10A:
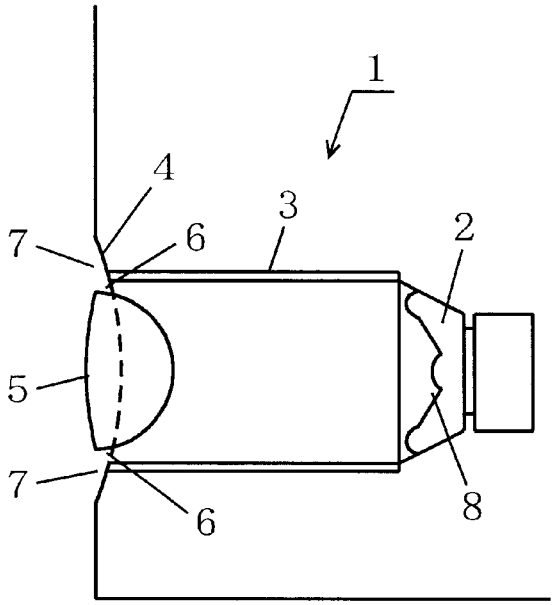
FIG. 10A is a schematic diagram showing one example of the shape of a fin in a speaker device according to a fourth embodiment of the present invention.
Figure 10B:
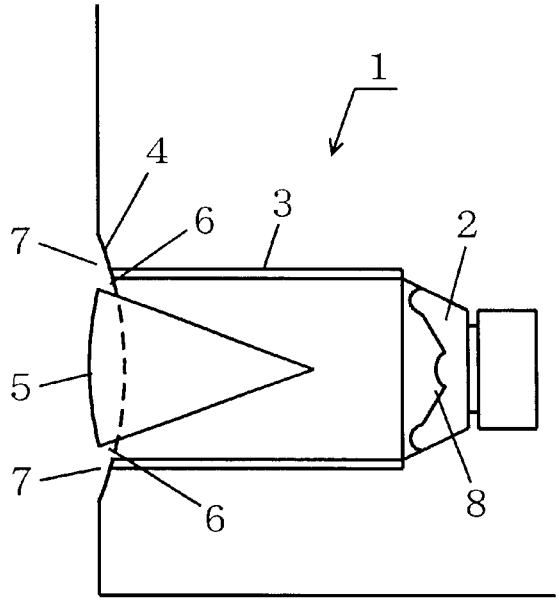
FIG. 10B is a schematic diagram showing another example of the shape of the fin in the speaker device according to the fourth embodiment of the present invention.

Although the shape of the fin 5 in FIG. 7 is similar to that in FIG. 2, the fin 5 may be of a shape as shown in FIG. 10A or 10B, or another shape. The position of the fin 5 is also not limited to that as shown in FIG. 2.

Fourth Embodiment

FIGS. 10A and 10B are schematic diagrams each showing a speaker device according to a fourth embodiment of the present invention. Since having functions similar to those in FIG. 2, the components shown in FIGS. 10A and 10B are provided with the same reference numerals as those in FIG. 2, and only the difference from FIG. 2 will be described below.

FIGS. 10A and 10B are cross-sectional views of the speaker device 1 taken from the side surface of the television. In FIG. 10A, the surface of the fin 5 opposed to the speaker 2 is curved rearwardly so that the center portion of the fin 5 is closer in position to the speaker 2 than both upper and lower ends thereof. Furthermore, the central portion on the rear of the fin 5 extends toward and beyond the corresponding speaker baffle 4, reaching inside of the sound duct 3. The cross section of the fin 5 viewed from the side surface of the television is a semicircle, as shown in FIG. 10A.

Also in FIG. 10B, similar to FIG. 10A, the surface of the fin 5 opposed to the speaker 2 is curved rearwardly so that the central portion of the fin 5 is closer in position to the speaker 2 than both upper and lower ends thereof. FIG. 10B is different from FIG. 10A; however, in that the cross section of the fin 5 viewed from the side surface of the television is of a triangular shape.

With such structures, the acoustic resistances of air viscosity toward the upper and lower slots 7 become equal. As a result, the acoustic characteristics of the speaker device 1 and the phase of output sound can be stabilized.

In other words, as stated above, if the acoustic resistance due to air viscous drag becomes small, the acoustic characteristics are improved. The acoustic resistance becomes larger as the angle of the surface of the fin 5 reflecting sound becomes closer to vertical with respect to a sound output direction. Therefore, the shape of the fin 5 is so formed such that the central portion on the rear of the fin 5 extends toward and beyond the central portion of the corresponding speaker baffle 4 to reach inside of the sound duct 3. Thus, the angle which the surface of the fin 5 forms with the direction of sound outputted from the speaker 2 becomes small, thereby allowing reduction in acoustic resistance and improvement in acoustic characteristics of the speaker device 1.

Furthermore, with the above-stated structures, the slots 7 become narrow and the sound source becomes analogous to a simple point source. Therefore, similar to the speaker device according to the first embodiment, the directivity can be broadened.

Fifth Embodiment

Figure 11:
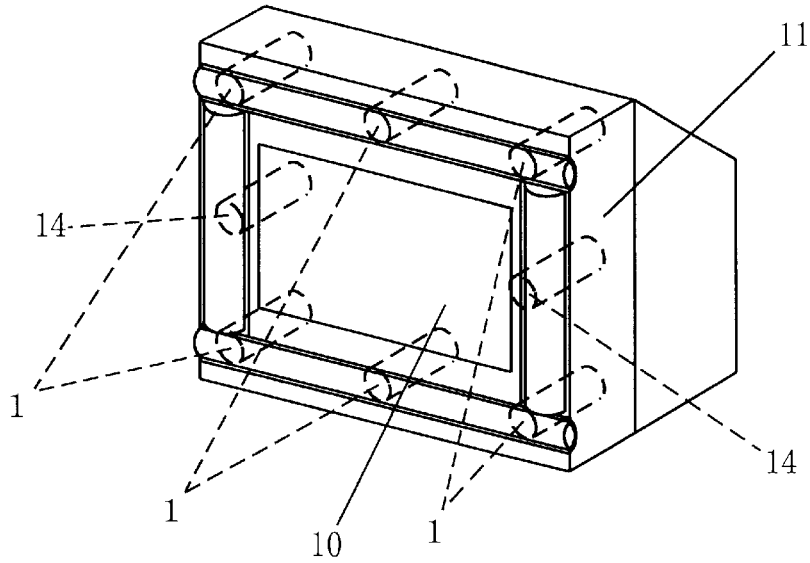
FIG. 11 is a perspective view of a television including speaker devices according to a fifth embodiment of the present invention.

FIG. 11 is a diagram showing the structure of speaker devices according to a fifth embodiment of the present invention, and a television including such speaker devices. Since having the same functions as those in FIG. 1, the components shown in FIG. 11 are provided with the same reference numerals as those in FIG. 1, and only the difference from FIG. 1 will be described below. The television in FIG. 11 is different from that in FIG. 1 in that high-frequency speaker devices 14 are provided.

In FIG. 11, the high-frequency speaker devices 14 are provided on the front-right and front-left of the television box 11, and the fin 5 is provided forward of each of the high-frequency speaker devices 14. With such structure, high-priced speaker devices having excellent acoustic characteristics for all ranges are not required, and therefore, the entire cost of the speaker devices can be reduced. Furthermore, even if the speaker devices 1 are provided on either upper-front or lower-front portions of the television box 11, the acoustic image can be placed in the vicinity of the center of the screen.

Still further, with the high-frequency speaker devices 14 provided on the front-right and front-left of the television box 11, the directivity in high-range frequencies can be broadened in the horizontal direction. Therefore, a listener can feel the sound spreading more.

Note that the high-frequency speaker device 14 may be dedicated to be used for high-range frequencies, or generally for high-range but not excluding mid-range frequencies. Also, the high-frequency speaker device 14 may be a speaker device for any frequency range, as is the speaker device 1. In such a case, the directivity in the horizontal direction can be broadened over the entire frequency range, and therefore, a listener can feel the sound spreading more.

Figure 12:
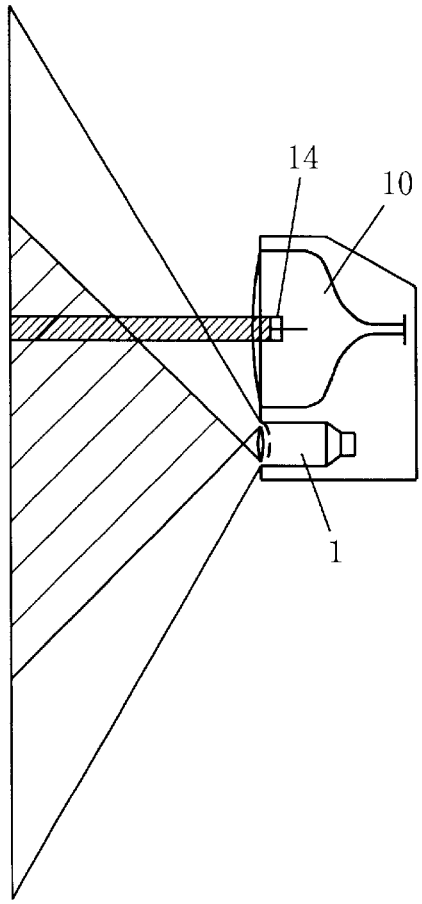
FIG. 12 is a schematic diagram showing vertical sound dispersion from the speaker device and a high-frequency speaker device according to the fifth embodiment of the present invention.

FIG. 12 is a schematic diagram showing vertical sound dispersion from the speaker device 1 and the high-frequency speaker device 14. As shown in FIG. 12, even if the speaker device 1 is provided on the lower-front of the television box 11, the acoustic image can be placed in the vicinity of the center of the screen.

Sixth Embodiment

Figure 13:
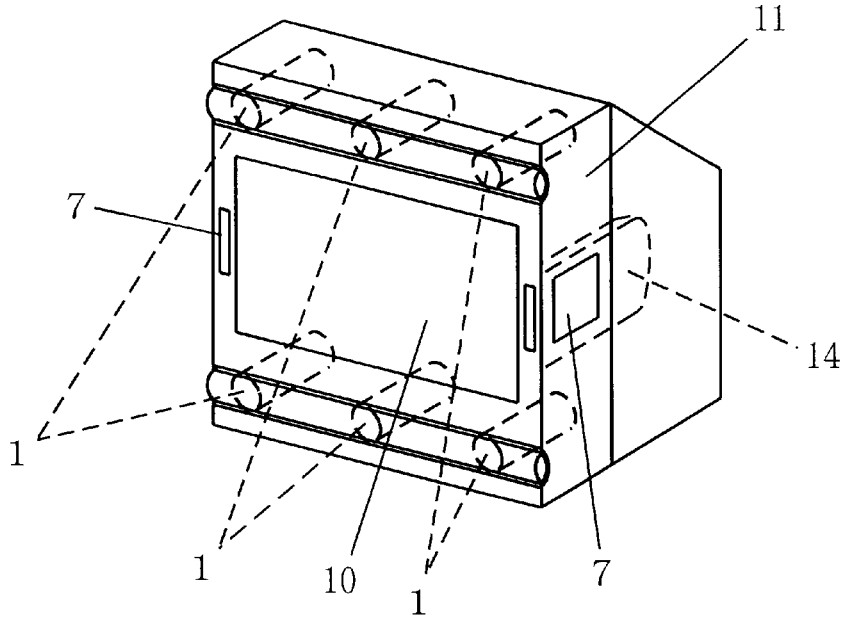
FIG. 13 is a perspective view of a television including speaker devices according to a sixth embodiment of the present invention to show the structure of slots.
Figure 14:
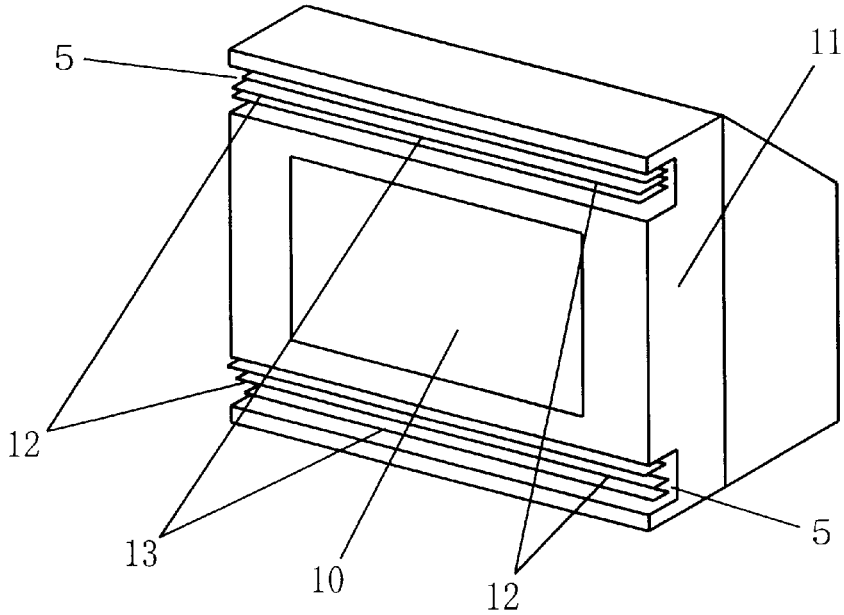
FIG. 14 PRIOR ART
FIG. 14 is a perspective view of a conventional television receiver equipped with television speaker devices having acoustic lenses.

FIG. 13 is a diagram showing the structure of speaker devices according to a sixth embodiment of the present invention, and a television including such speaker devices. Since having the same functions as those in FIG. 11, the components shown in FIG. 13 are provided with the same reference numerals as those in FIG. 11, and only the difference from FIG. 11 will be described below. The television in FIG. 13 is different from that in FIG. 11 in that the fin 5 is not provided forward of each of the high-frequency speaker devices 14.

FIG. 13 shows that the slots 7 for the high-frequency speaker devices 14 are provided on the front-right and front-left of the television box 11, and the right and left side surfaces of the television box 11. As shown in FIG. 13, the high-frequency speaker devices 14 are provided on the right and left of the television box 11. The slots 7 for the high-frequency speaker devices 14 are provided either on the front-right and front-left, or on the right and left sides, or both, of the television box 11. With such structure, the slots 7 can be visually simplified. Therefore, the width of the front surface of the television with the width of its screen subtracted therefrom can be reduced.

Still further, similar to the case shown in FIG. 11, with the high-frequency speaker devices 14 provided on the front-right and front-left of the television box 11, the directivity in high-range frequencies can be broadened in the horizontal direction. Therefore, a listener can feel the sound spreading more.

In the foregoing embodiments, description is made supposing the the speaker devices are applied to a television. Needless to say; however, the speaker device according to each of the above embodiments may also be applied to video equipment such as a display monitor and personal computer.

While the invention has been described in detail, the foregoing description is in all aspects illustrative and not restrictive. It is understood that numerous other modifications and variations can be devised without departing from the scope of the invention.

What is claimed is:

1. A video equipment speaker device comprising:

a speaker for forwardly outputting sound;

a speaker baffle provided forward of said speaker, said speaker baffle having an inner periphery and an opening through which sound outputted from said speaker is to pass; and a fin having an outer periphery and a surface opposed to said speaker, said fin cooperating with said speaker baffle so as to define slots, for sound passage, between said inner periphery of said speaker baffle and said outer periphery of said fin, and said fin having a cross sectional shape such that a central portion of said surface opposed to said speaker is rearwardly curved, such that when sound is outputted from said speaker, the sound passes through said slots and reflects between said fin and said speaker baffle to be externally outputted from said slots.

2. The video equipment speaker device according to claim 1, wherein said fin is of such a shape that the opening of said speaker baffle is not entirely covered when viewed from a front of said fin.

3. The video equipment speaker device according to claim 2, wherein said fin is positioned such that said fin does not intersect with a central axis of the sound when outputted from said speaker.

4. The video equipment speaker device according to claim 3, wherein said speaker, speaker baffle and fin are positioned such that the central axis of the sound when outputted from said speaker passes through one of said slots defined between said fin and said speaker baffle, and part of the sound when outputted from said speaker is directly outputted from one of said slots.

5. The video equipment speaker device according to claim 1, wherein said fin is of a rectangular shape when viewed from a front of said fin.

6. The video equipment speaker device according to claim 1, wherein said fin has at least one aperture such that part of the sound when outputted from said speaker is externally outputted through said at least one aperture.

7. The video equipment speaker device according to claim 1, wherein a total area of the said slots defined between said fin and said speaker baffle, that correspond to the opening of said speaker baffle, is approximately equal to an area of the opening of said speaker baffle.

8. The video equipment speaker device according to claim 1, wherein a central portion of said rearwardly-curved surface of said fin is positioned through said opening of said speaker baffle such that said central portion of said rearwardly curved surface is closer to said speaker than is said speaker baffle.

9. The video equipment speaker device according to claim 1, wherein said video equipment speaker device is provided on an upper-front and/or lower-front of video equipment.

10. The video equipment speaker device according to claim 1, wherein said video equipment speaker device is provided on a front-right and front-left of video equipment.

11. The video equipment speaker device according to claim 1, wherein said video equipment speaker device is provided on an upper-front and/or lower-front and a front-right and front-left of video equipment.

12. The video equipment speaker device according to claim 11, wherein said video equipment speaker device provided on the front-right and the front-left of the video equipment is to be used for high-range frequencies.

13. A video unit comprising:

a video unit box that accommodates a video unit circuit set;

at least one first speaker device provided on an upper-front and/or lower-front of said video unit box; and second speaker devices provided on a front-right and front-left of said video unit box, wherein said second speaker devices are to be used for high-range frequencies, wherein said at least one first speaker device includes (i) a speaker for forwardly outputting sound, (ii) a speaker baffle provided forward of said speaker, said speaker baffle having an inner periphery and an opening through which sound outputted from said speaker is to pass, and (iii) a fin having an outer periphery and a surface opposed to said speaker, said fin cooperating with said speaker baffle so as to define slots, for sound passage, between said inner periphery of said speaker baffle and said outer periphery of said fin, and said fin having a cross sectional shape such that a central portion of said surface opposed to said speaker is rearwardly curved, such that when sound is outputted from said speaker, the sound passes through said slots and reflects between said fin and said speaker baffle to be externally outputted from said slots.

14. A video equipment speaker device comprising:

a speaker for forwardly outputting sound;

a speaker baffle provided forward of said speaker with an opening through which sound outputted from said speaker is to pass; and a fin having a surface opposed to said speaker, said fin cooperating with said speaker baffle so as to define slots for sound passage, said fin having a cross sectional shape such that a central portion of said surface opposed to said speaker is rearwardly curved, and said fin being of such a shape that the opening of said speaker baffle is not entirely covered when viewed from a front of said fin, such that when sound is outputted from said speaker, the sound passes through said slots and reflects between said fin and said speaker baffle to be externally outputted from said slots.

15. The video equipment speaker device according to claim 14, wherein said fin is positioned such that said fin does not intersect with a central axis of the sound when outputted from said speaker.

16. The video equipment speaker device according to claim 15, wherein said speaker, speaker baffle and fin are positioned such that the central axis of the sound when outputted from said speaker passes through one of said slots defined between said fin and said speaker baffle, and part of the sound when outputted from said speaker is directly outputted from one of said slots.

17. A video equipment speaker device comprising:

a speaker for forwardly outputting sound;

a speaker baffle provided forward of said speaker with an opening through which sound outputted from said speaker is to pass; and a fin having a surface opposed to said speaker, said fin cooperating with said speaker baffle so as to define slots for sound passage, said fin having a cross sectional shape such that a central portion of said surface opposed to said speaker is rearwardly curved, and said fin being of a rectangular shape when viewed from a front of said fin, such that when sound is outputted from said speaker, the sound passes through said slots and reflects between said fin and said speaker baffle to be externally outputted from said slots.

18. A video equipment speaker device comprising:

a speaker for forwardly outputting sound;

a speaker baffle provided forward of said speaker with an opening through which sound outputted from said speaker is to pass; and a fin having a surface opposed to said speaker, said fin cooperating with said speaker baffle so as to define slots for sound passage, and said fin having a cross sectional shape such that a central portion of said surface opposed to said speaker is rearwardly curved, such that when sound is outputted from said speaker, the sound passes through said slots and reflects between said fin and said speaker baffle to be externally outputted from said slots, wherein a total area of said slots defined between said fin and said speaker baffle, that correspond to the opening of said speaker baffle, is approximately equal to an area of the opening of said speaker baffle.

* * * * *